US011721944B2

(12) United States Patent
Watkins et al.

(10) Patent No.: US 11,721,944 B2
(45) **Date of Patent: *Aug. 8, 2023**

(54) COAXIAL CONNECTOR HAVING A BREAKAWAY COMPRESSION RING AND TORQUE MEMBER

(71) Applicant: PPC BROADBAND, INC., East Syracuse, NY (US)

(72) Inventors: Harold J. Watkins, Chittenango, NY (US); Richard Maroney, Camillus, NY (US); Steve Stankovski, Clay, NY (US); Chris Shyne, Manlius, NY (US); Amos Mckinnon, Liverpool, NY (US)

(73) Assignee: PPC BROADBAND, INC., East Syracuse, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/354,492

(22) Filed: Jun. 22, 2021

(65) Prior Publication Data

US 2021/0313754 A1 Oct. 7, 2021

Related U.S. Application Data

(63) Continuation of application No. 16/513,671, filed on Jul. 16, 2019, now Pat. No. 11,043,781, which is a (Continued)

(51) Int. Cl.
*H01R 43/027* (2006.01)
*H01R 4/50* (2006.01)
(Continued)

(52) U.S. Cl.
CPC ..... *H01R 43/027* (2013.01); *H01R 4/50* (2013.01); *H01R 24/40* (2013.01); *H01R 13/521* (2013.01); *H01R 13/5202* (2013.01)

(58) Field of Classification Search
CPC ..... H01R 13/5202; H01R 13/521; H01R 43/027; H01R 24/40; H01R 4/50
See application file for complete search history.

(56) References Cited

U.S. PATENT DOCUMENTS 4,575,274 A 3/1986 Hayward
6,042,422 A 3/2000 Youtsey
(Continued)

OTHER PUBLICATIONS

Search Report dated Oct. 7, 2019 in corresponding International Application No. PCT/US2019/042093, 2 pages.
(Continued)

*Primary Examiner* — Briggitte R. Hammond
(74) *Attorney, Agent, or Firm* — MH2 Technology Law Group LLP

(57) ABSTRACT

A connector includes a body having a cable receiving end configured to receive the end of the coaxial cable, a coupler configured to be coupled with and to rotate relative to the body, and a compression ring including a forward sleeve portion and a rearward outer ring portion attached to one another by a plurality of tabs. The forward sleeve portion is configured to be coupled to the cable receiving end of the body, and the plurality of tabs are configured to shear so as to separate the rearward outer ring portion from the forward sleeve portion when a desired force is met as the compression ring is moved relative to the body. The rearward outer ring includes an inner opening when separated from the forward sleeve portion, the separated rearward outer ring is configured to be slidingly moved relative to the body and the coupler, and the inner opening is configured to fit over the coupler such that the rearward outer ring is configured to be a torque assist member.

43 Claims, 10 Drawing Sheets

Related U.S. Application Data continuation-in-part of application No. 16/443,856, filed on Jun. 17, 2019, now Pat. No. 11,095,072.

(60) Provisional application No. 62/698,344, filed on Jul. 16, 2018, provisional application No. 62/685,908, filed on Jun. 15, 2018.

(51) Int. Cl.
*H01R 13/52* (2006.01)
*H01R 24/40* (2011.01)

(56) References Cited

U.S. PATENT DOCUMENTS

| | | | |
|---|---|---|---|
| 6,086,282 | A | 7/2000 | Dutt et al. |
| 7,029,305 | B2 | 4/2006 | Weidner |
| 7,544,094 | B1 | 6/2009 | Paglia et al. |
| 8,048,115 | B2 | 11/2011 | Winslow et al. |
| 8,568,167 | B2 | 10/2013 | Montena |
| 8,591,244 | B2 | 11/2013 | Thomas et al. |
| 9,564,695 | B2 | 2/2017 | Hammons et al. |
| 9,929,498 | B2 | 3/2018 | Thakare et al. |
| 9,929,499 | B2 | 3/2018 | Thakare et al. |
| 9,997,875 | B2 | 6/2018 | Roe et al. |
| 10,270,206 | B2 | 4/2019 | Thakare et al. |
| 11,095,072 | B2 * | 8/2021 | Watkins ..... H01R 9/0521 |
| 2007/0049113 | A1 | 3/2007 | Rodrigues et al. |
| 2010/0081322 | A1 | 4/2010 | Malloy et al. |
| 2010/0273352 | A1 | 10/2010 | Amidon et al. |
| 2013/0029513 | A1 | 1/2013 | Montena |
| 2015/0118901 | A1 | 4/2015 | Burris |
| 2016/0072204 | A1 | 3/2016 | Edmonds et al. |
| 2017/0365949 | A1 | 12/2017 | Montena et al. |
| 2018/0062307 | A1 | 3/2018 | Thakare et al. |
| 2018/0183192 | A1 | 6/2018 | Youtsey |

OTHER PUBLICATIONS

Written Opinion dated Oct. 7, 2019 in corresponding International Application No. PCT/US2019/042093, 5 pages.

International Preliminary Report on Patentability dated Jan. 19, 2021 in corresponding International Application No. PCT/US2019/042093, 6 pages.

Search Report dated Sep. 10, 2019 in corresponding International Application No. PCT/US2019/037560, 2 pages.

Written Opinion dated Sep. 10, 2019 in corresponding International Application No. PCT/US2019/037560, 6 pages.

International Preliminary Report on Patentability dated Dec. 15, 2020 in corresponding International Application No. PCT/US2019/037560, 7 pages.

* cited by examiner

COAXIAL CONNECTOR HAVING A BREAKAWAY COMPRESSION RING AND TORQUE MEMBER

CROSS-REFERENCE TO RELATED APPLICATIONS

This application is a Continuation of U.S. patent application Ser. No. 16/513,671 filed Jul. 16, 2019, which is a Continuation-in-Part of U.S. patent application Ser. No. 16/443,856 filed on Jun. 17, 2019, which claims the benefit of U.S. Provisional Application No. 62/685,908, filed on Jun. 15, 2018. This application also claims the benefit of U.S. Provisional Application No. 62/698,344, filed on Jul. 16, 2018. The disclosures of the above applications are hereby incorporated by reference in their entirety.

TECHNICAL FIELD

The present disclosure relates generally to connectors for terminating coaxial cable. More particularly, the present disclosure relates to a coaxial cable connector having a torque-limiting compression ring that does not require a compression tool for installation and that breaks away from the connector body for use as a torque member.

BACKGROUND

It has long been known to use connectors to terminate coaxial cable so as to connect a cable to various electronic devices such as televisions, radios and the like. Conventional coaxial cables typically include a center conductor surrounded by an insulator. A braided or foil conductive shield is disposed over the insulator. An outer insulative jacket surrounds the shield. In order to prepare the coaxial cable for termination, the outer jacket is stripped back exposing an extent of the conductive shield which is folded back over the jacket. A portion of the insulator extends outwardly from the jacket and an extent of the center conductor extends outwardly from insulator. Such a prepared cable may be terminated in a conventional coaxial connector.

Coaxial connectors of this type include a connector body having an inner cylindrical post which is inserted between the insulator and the conductive shield. A compression ring is provided to secure the cable within the body of the coaxial connector. The compression ring, which is typically formed of a resilient plastic, is securable to the connector body to secure the coaxial connector thereto. Conventional connectors of this type require a compression tool for installation. Thus, installers need to carry these compression tools into the field and, if the compression tool breaks or is misplaced, the conventional connectors cannot be assembled to a coaxial cable.

Additionally, some conventional compression tools may not be configured to ensure that the compression ring provides a desired amount of compression to the coaxial cable. For example, use of such conventional compression tools may result in a connector that is assembled to a coaxial cable with insufficient compression, which could lead to the connector becoming loosened from the cable, thus resulting in a degraded signal or signal loss. On the other hand, use of such conventional compression tools may result in a connector that is assembled to a coaxial cable with too much compression, which could damage the cable, thus resulting in a degraded signal or signal loss.

Therefore, is may be desirable to provide a coaxial connector that can be assembled to a coaxial cable without the use of a compression tool. Further, it may be desirable to provide a coaxial connector that can be assembled to a coaxial cable with a desired amount of compression. It may be further desirable to provide a coaxial connector that includes a breakaway ring that can be used to apply torque to the connector when tightening the connector to an interface port.

SUMMARY

In accordance with various embodiments of the disclosure, a coaxial cable connector configured to terminate an end of a coaxial cable and to be coupled with an interface port includes a body, a torque-limiting compression ring, a coupler, and an outer conductor engager. The body includes a rearward portion for accommodating a coaxial cable and a forward portion for coupling with the outer conductor engager, and the outer conductor engager is configured to couple the body with the coupler such that the coupler is rotatingly coupled relative to the body and the outer conductor engager. The torque-limiting compression ring includes a generally cylindrical forward sleeve portion and a rearward outer ring portion, and the rearward outer ring portion is attached to the forward sleeve portion by a plurality of tabs that taper in a radially outward direction. The torque-limiting compression ring is configured to be rotated relative to the body, and such relative rotation moves the torque-limiting compression ring axially relative to the body and compresses a cable between an inner surface of the torque-limiting compression ring and an outer surface of the outer conductor engager. The plurality of tabs are configured to shear when a desired torque is met as the torque-limiting compression ring is rotated relative to the body such that the outer ring portion becomes separated from the forward sleeve portion, the rearward outer ring portion includes an inner opening when separated from the forward sleeve portion, the separated rearward outer ring is configured to be slidingly moved relative to the body and the coupler, and the inner opening is configured to fit over the coupler such that the rearward outer ring is configured to be a torque assist member.

According to some aspects, a material of the tabs, the tapering of the tabs, and/or strengthening members at a radially outer portion of the tabs facilitate breakage of the tabs at a radially inner portion of the tabs that connects to the forward sleeve portion.

In various aspects, the inner opening has a shape that matches a shape of an outer surface of the coupler.

According to some embodiments of the disclosure, a connector includes a body having a cable receiving end configured to receive the end of the coaxial cable, a coupler configured to be coupled with and to rotate relative to the body, and a compression ring including a forward sleeve portion and a rearward outer ring portion attached to one another by a plurality of tabs. The forward sleeve portion is configured to be coupled to the cable receiving end of the body, and the plurality of tabs are configured to shear so as to separate the rearward outer ring portion from the forward sleeve portion when a torque for rotating the compression ring relative to the body exceeds a desired torque. The rearward outer ring includes an inner opening when separated from the forward sleeve portion, the separated rearward outer ring is configured to be slidingly moved relative to the body and the coupler, and the inner opening is configured to fit over the coupler such that the rearward outer ring is configured to be a torque assist member.

In accordance with some aspects, the outer ring portion includes one or more torque assisting structures.

In various aspects, the compression ring is formed of a material selected such that each of the plurality of tabs will shear at a radially inner portion of each of the tabs that connects to the forward sleeve portion when the desired torque is met.

According to some aspects, each of the tabs includes a strengthening member at its radially outer portion. The strengthening members being configured to facilitate breakage of the tabs at a radially inner portion of each of the tabs that connects to the forward sleeve portion.

In accordance with various aspects, body includes at least one stop configured to prevent the compression ring from being overtightened to the body.

According to some aspects, an outer surface of the forward sleeve portion of the compression ring includes a threaded portion that is configured to be threadedly coupled with a threaded portion of an inner surface of the body. In some aspects, the threaded portions allow for detachable, re-attachable connection of the compression ring to the body.

In various aspects, the compression ring is configured to move axially toward a coupler at a forward end of the connector as the compression ring is rotated clockwise relative to the body. According to some aspects, the compression ring is configured to move axially from a first position, which loosely retains a coaxial cable within the body, to a more forward second position, which secures the cable within the body, as the compression ring is rotated clockwise relative to the body.

In accordance with some aspects, the coupler is configured to provide mechanical attachment of the connector to an interface port of an external device.

According to various aspects, the connector further includes a resilient sealing O-ring positioned between the body and the coupler at the rotatable juncture thereof to provide a seal thereat.

In some aspects, the connector further includes an outer conductor engager. The body includes a forward portion for coupling with the outer conductor engager, and the outer conductor engager is configured to couple the body with the coupler such that the coupler is rotatingly coupled relative to the body and the outer conductor engager. In various aspects, the connector further includes a sealing gasket disposed at a forward end of the outer conductor engager to provide a weather tight seal between the coupler, the outer conductor engager, and the interface port.

In accordance with various aspects, the inner opening has a shape that matches a shape of an outer surface of the coupler.

According to some aspects, the plurality of tabs taper in a radially outward direction.

In another embodiment, the present disclosure provides a method for attaching a connector to an interface port including inserting a coaxial cable through a rearward end of a compression ring and into a body of the connector, moving the torque-limiting compression ring relative to the body from a first position loosely retaining the cable to a second position which is axially forward, thereby locking the cable to the body, rotating the torque-limiting compression ring relative to the body until a plurality of tabs that attach a rearward outer ring portion of the compression ring with a forward sleeve portion of the compression ring shear so that the outer ring portion becomes separated from the forward sleeve portion, moving the outer ring portion axially forward relative to the body and over a coupler, coupling the coupler with an interface port, and using the outer ring portion as a torque assist member to tighten the coupler to the interface port.

In some aspects, the method further includes, before the inserting step, detaching the compression ring from the body, placing the compression ring around the coaxial cable, inserting the coaxial cable into the rearward end of the body while the compression ring is detached, and reattaching the compression ring to the rearward end of the body.

The foregoing and other features of construction and operation of the invention will be more readily understood and fully appreciated from the following detailed disclosure, taken in conjunction with accompanying drawings. Throughout the description, like reference numerals will refer to like parts in the various embodiments and drawing figures.

DETAILED DESCRIPTION OF EMBODIMENTS

Figure 1:
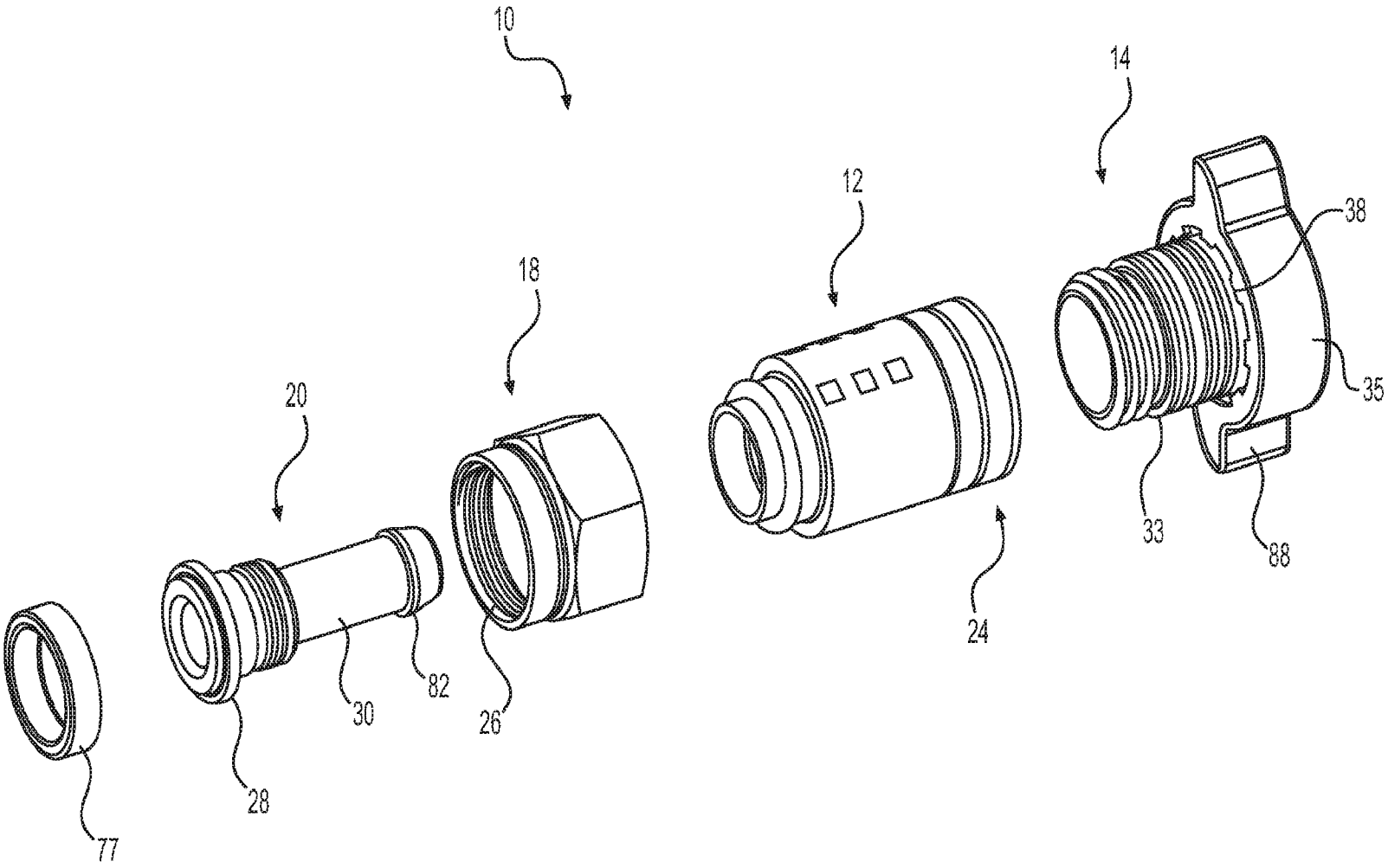
FIG. 1 is an exploded perspective view of an exemplary coaxial connector in accordance with various aspects of the present disclosure.

As a preface to the detailed description, it should be noted that, as used in this specification and the appended claims, the singular forms "a," "an," and "the" include plural referents, unless the context clearly dictates otherwise.

FIGS. 1-6 illustrate an exemplary coaxial cable connector 10 in accordance with various aspects of the present disclosure. The connector 10 includes a body 12, a torque-limiting compression ring 14, a coupler 18 such as an annular nut, and an outer conductor engager or annular post 20. The body 12 is an elongate, generally cylindrical conductive member, which may be made, for example, of a metal such as, but not limited to, brass. The body 12 includes a rearward portion 16 for accommodating a coaxial cable and a forward portion 15 for coupling with the post 20.

The post 20 couples the forward portion 15 of the body 12 with the coupler 18 such that the coupler 18 is rotatingly coupled to the body 12 and the post 20 to provide mechanical attachment of the connector 10 to an interface port 99 of an external device. For example, the post 20 may include a rearward-facing shoulder 21 that cooperates with a forward-facing shoulder 19 of the coupler 18 to provide the rotatable coupling. A resilient sealing O-ring 22 may be positioned between the body 12 and the coupler 20 at the rotatable juncture thereof to provide a seal thereat. A sealing gasket 77 may be disposed at the forward end of the post 20 to provide a weather tight seal between the coupler 18, the post 20, and the interface port.

The rearward portion 16 of the body 12 includes a cable receiving end 24 for insertably receiving an inserted coaxial cable. The coupler 18 includes an internally threaded end 26 permitting screw threaded attachment of the connector 10 to the interface port 99 of an external device. The cable receiving end 24 is at a rearward end of the rearward portion 16 of the body 12, and the internally threaded end 26 is at a forward end of the coupler 18.

The post 20 includes a base portion 28 which provides for securement of the coupler 18 between the body 12 and the post 20 and an annular tubular extension 30 extending rearward from the base portion 28 into the body 12. Also, an inner surface 40 of the forward portion 15 of the body 12 may include a retention structure 42, for example, a radial inward protrusion, that is mechanically coupled with a retention structure 52, for example, a notch of the outer surface 50 of the annular tubular extension 30 of the post 20. The retention structures 42, 52 may extend about the entire circumference or a portion of the circumference of the body and the tubular extension, respectively. It should be appreciated that the retention structures 42, 52 may be reversed in some embodiments such that retention structure 42 is a notch and retention structure 52 is a protrusion. As will be described in further detail hereinbelow and as is conventionally known, the extension 30 of the post 20 and the rearward portion 16 of the body 12 define an annular opening 32 for accommodating the jacket and shield of the inserted coaxial cable.

The torque-limiting compression ring 14 includes a generally cylindrical forward sleeve portion 33 and a rearward outer ring portion 35. The rearward outer ring portion 35 is attached to the forward sleeve portion 33 by a plurality of tabs or fingers 38 that taper in the radially inward direction. The outer ring portion 35 may include one or more torque assisting structures 88. The compression ring 14 is formed of a material selected such that the plurality of tabs 38 will shear when a desired torque is met during installation, as described in more detail below. In some aspects, each of the tabs 38 may include a strengthening member 39 at its radially outer portion 60. The tapering of the tabs 38 and the strengthening members 39 facilitate breakage of the tabs 38 at a radially inner portion 62 of the tabs 38 that connects to the forward sleeve portion 33. Also, the body 12 includes a first stop 17 at the rearward end of the rearward portion 16 and a second stop 19 formed by a shoulder extending radially inward from an inner surface 13 of the rearward portion 12. The first and second stops 17, 19 prevent the compression ring 14 from being overtightened to the body 12.

The forward sleeve portion 33 has a flared rearward end 34 through which a cable may be inserted and an opposite forward end 36 which is insertable into the cable receiving end 24 of the body 12. An outer surface 64 of the forward end 36 of the compression ring 14 includes a threaded portion 66 that is threadedly coupled with a threaded portion 68 of the inner surface 13 of the rearward portion 16 of the body 12. The threaded portions 66, 68 allow for detachable, re-attachable connection of the compression ring 14 to the body 12. Furthermore, as the compression ring 14 is rotated clockwise relative to the body 12, the compression ring 14 is axially moved along a direction of arrow A of FIG. 2, towards the coupler 18 from a first position shown in FIGS. 2 and 4, which loosely retains the coaxial cable within the body 12 to a more forward second position shown in FIG. 3, which secures the cable within the body 12.

Figure 4:
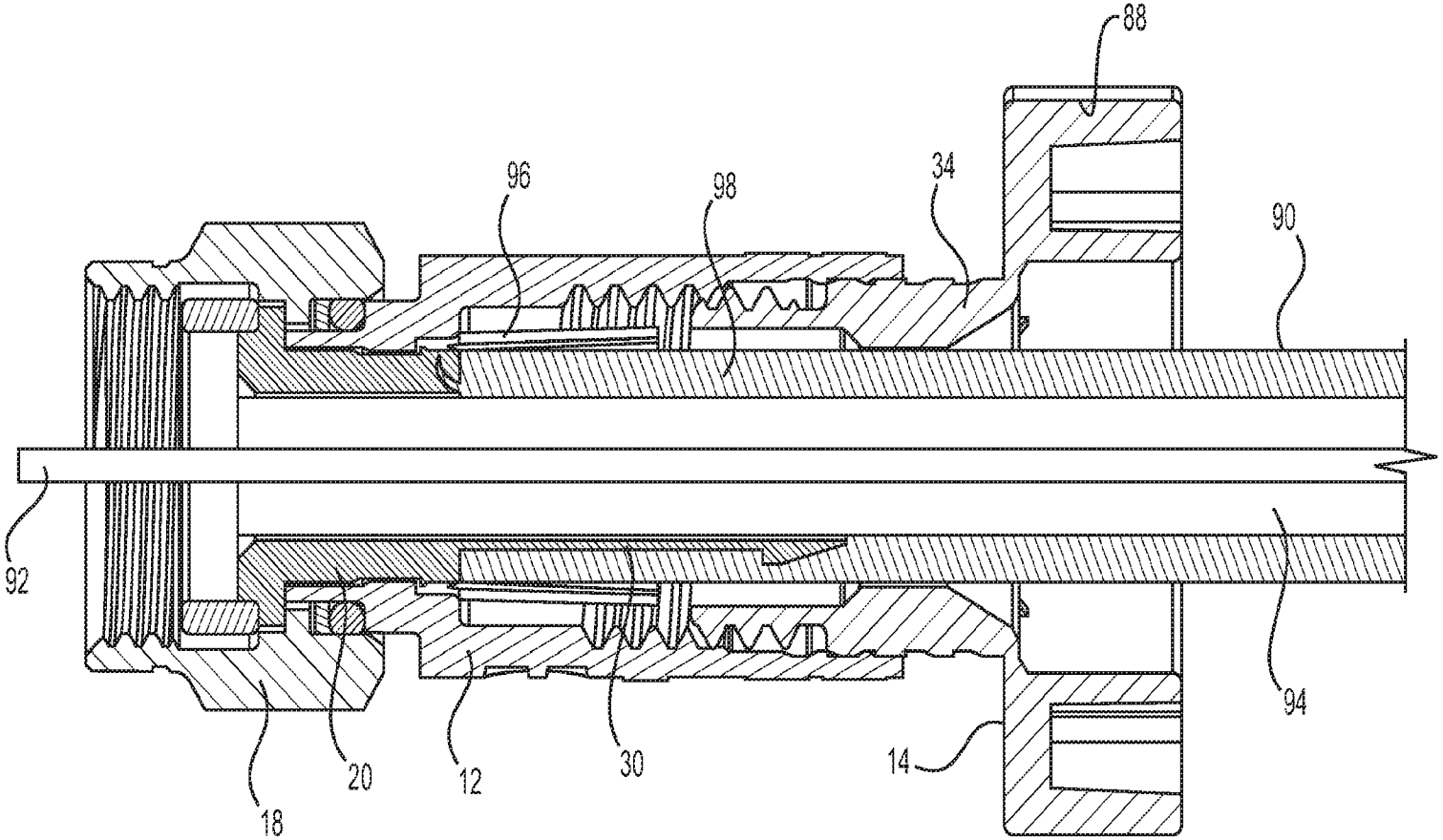
FIG. 4 is a side cross-sectional view of the exemplary coaxial connector of FIG. 1 with a coaxial cable.
Figure 5:
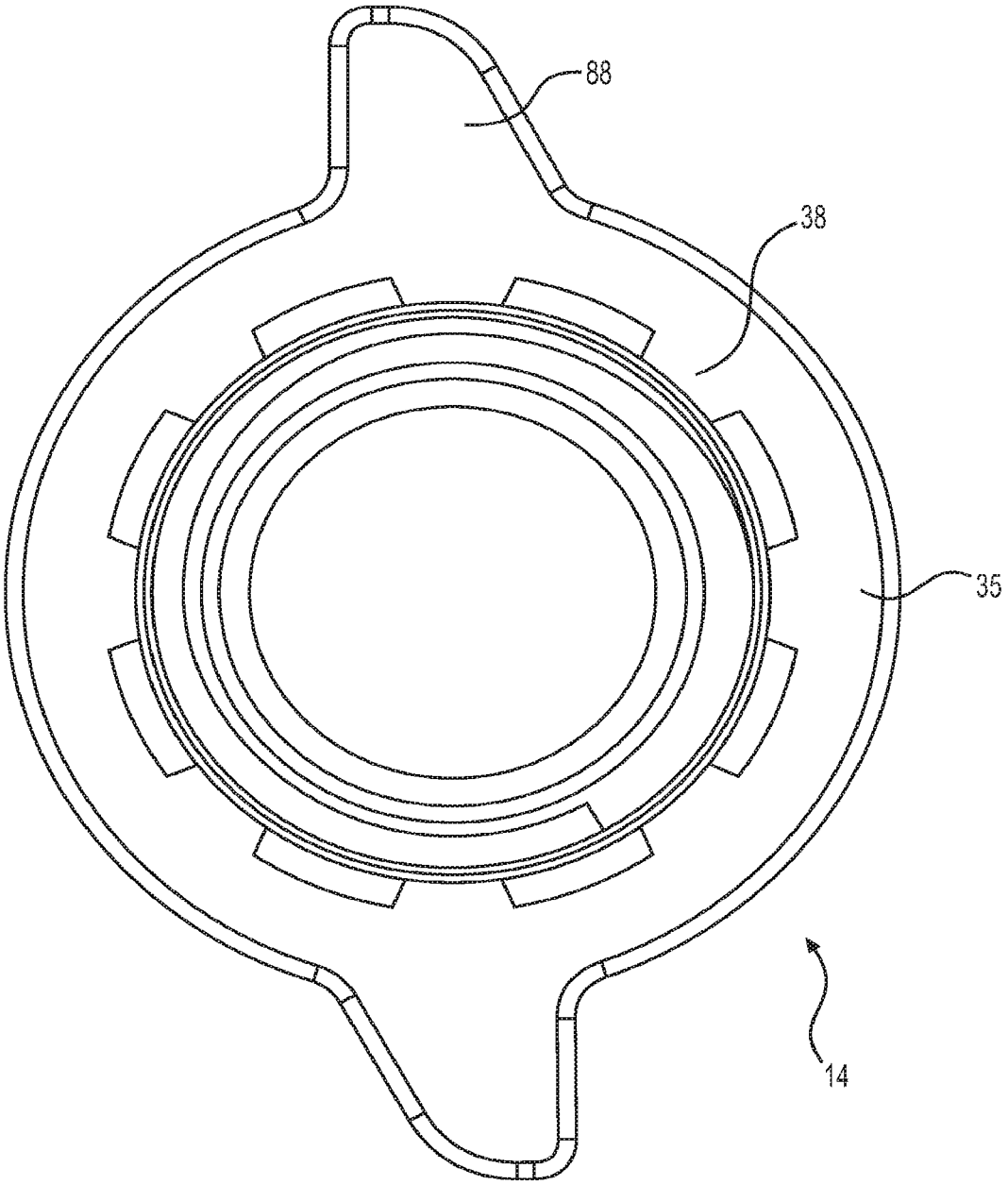
FIG. 5 is a front view of the exemplary coaxial connector of FIG. 1.
Figure 6:
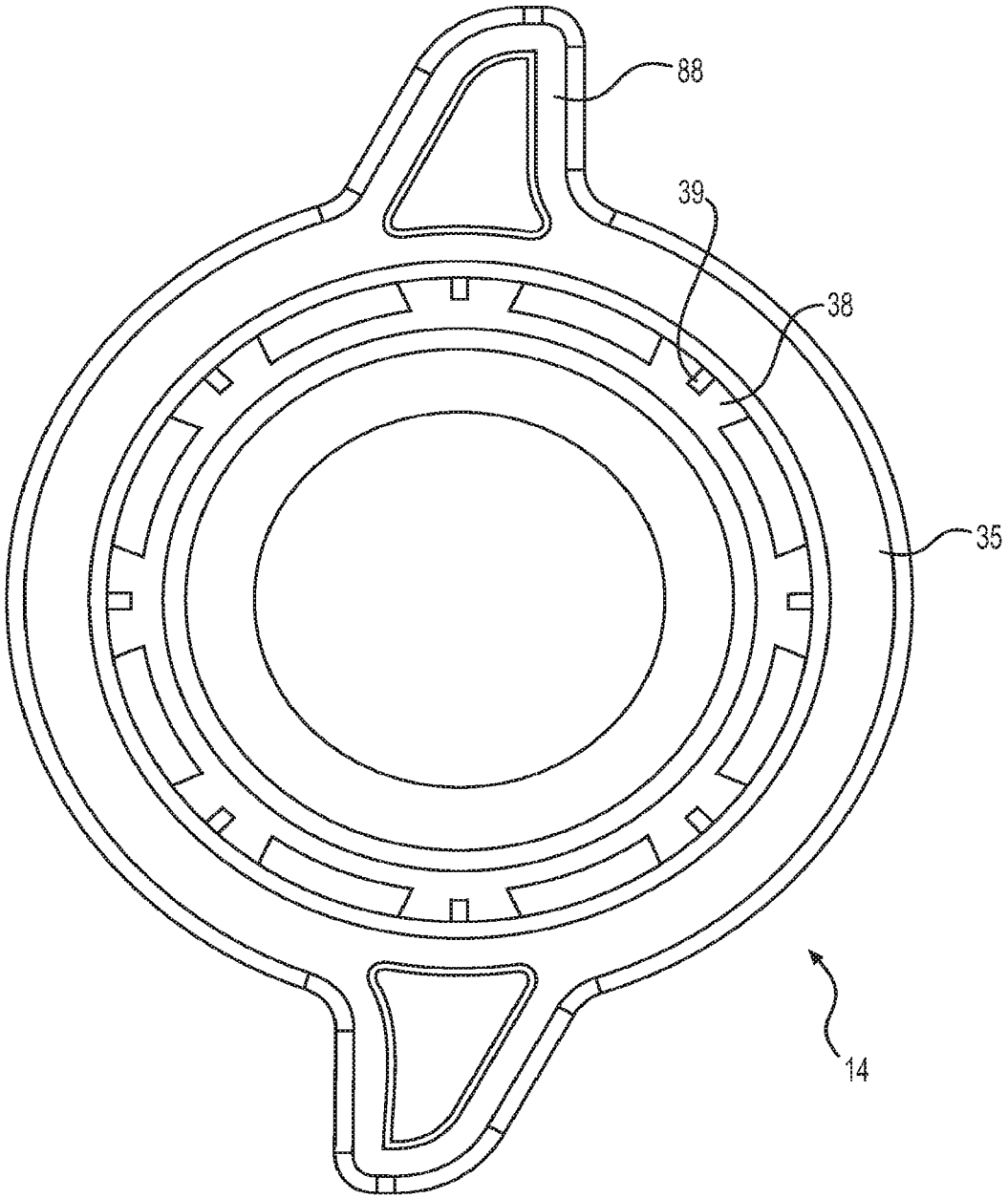
FIG. 6 is a rear view of the exemplary coaxial connector of FIG. 1.
Figure 7:
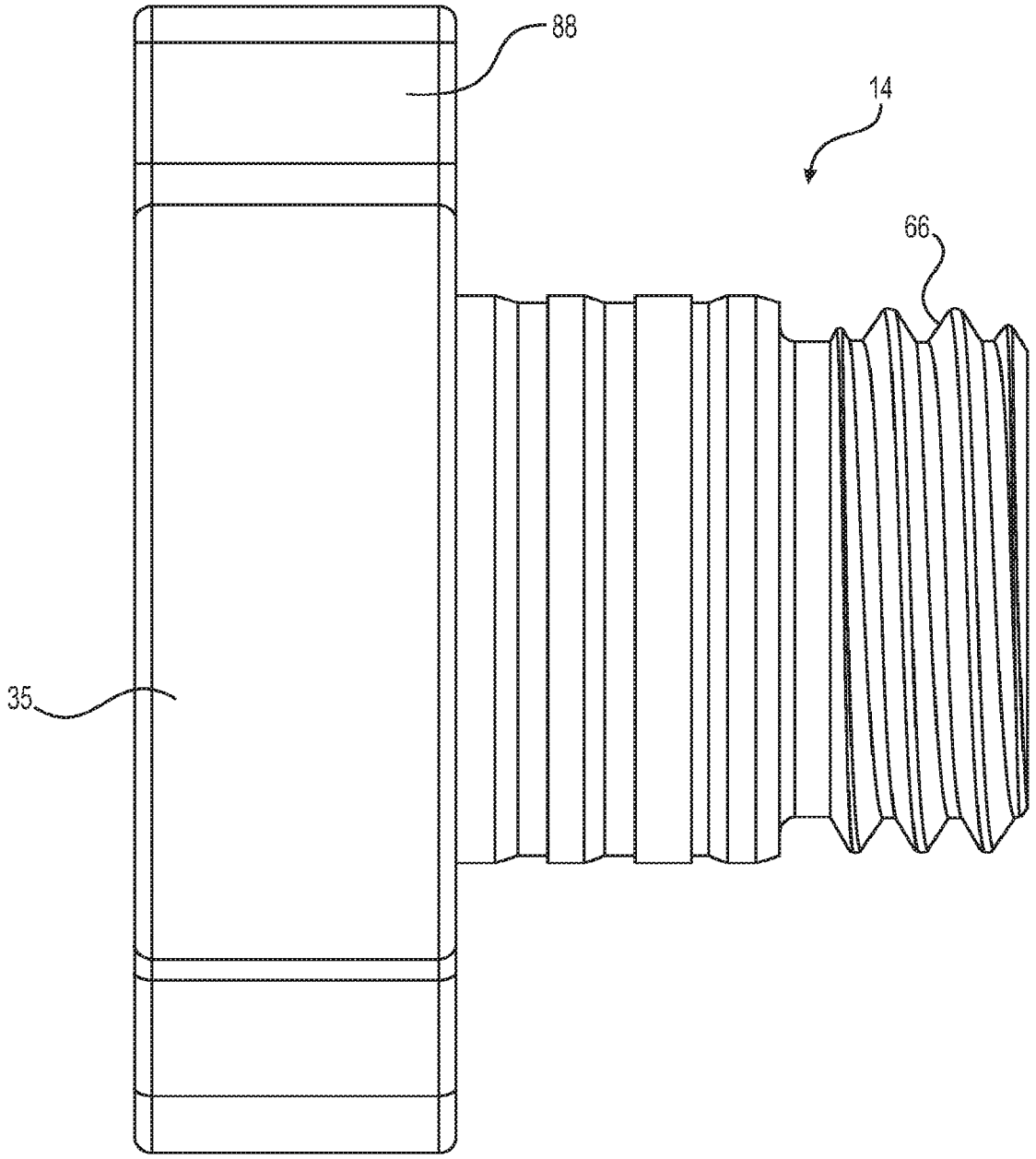
FIG. 7 is a side view of the compression ring of the exemplary coaxial connector of FIG. 1.

Having described the components of connector 10 in detail, the use of connector 10 in terminating a coaxial cable may now be described with respect to FIG. 4. The coaxial cable 90 includes an elongate inner conductor 92 formed of copper or similar conductive material. Extending around the inner conductor 92 is a conductor insulator 94 formed of a suitably insulative plastic. A metallic shield 96 is positioned in surrounding relationship around the insulator 94. In some aspects, the shield 96 is a metallic braid, however, other conductive materials such as metallic foil may also be employed. Covering the shield 96 is an outer insulative jacket 98.

Figure 2:
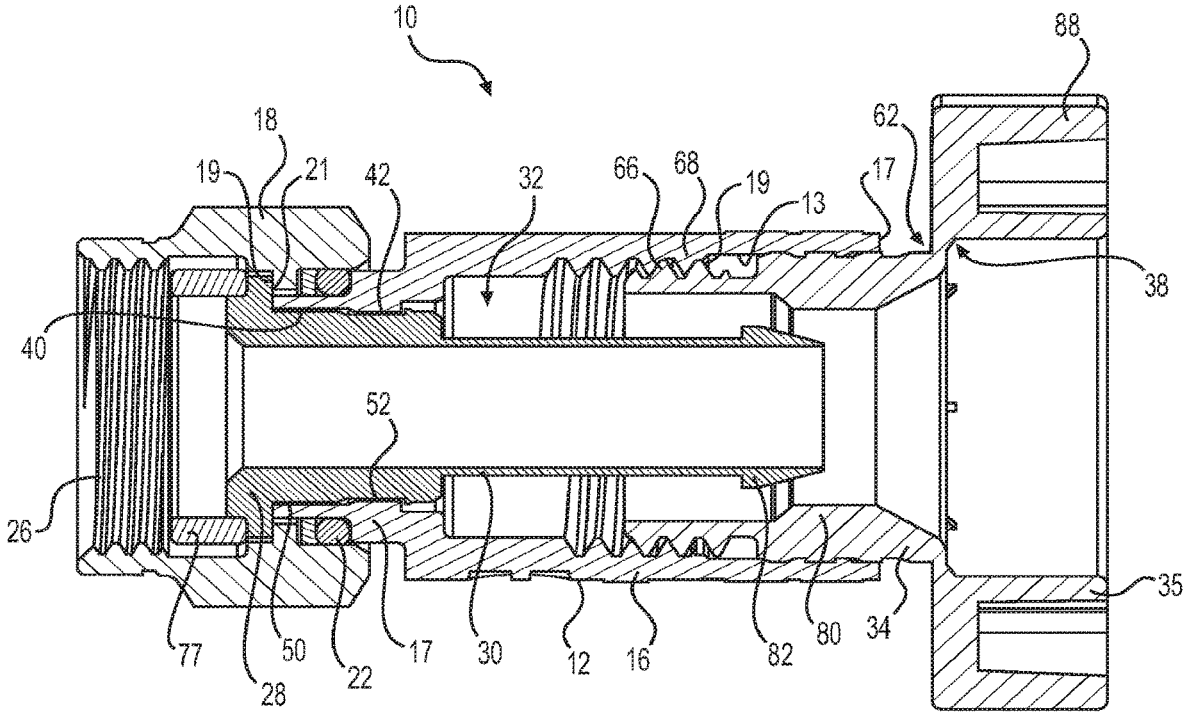
FIG. 2 is a side cross-sectional view of the exemplary coaxial connector of FIG. 1.

Cable 90 is prepared in conventional fashion for termination, by stripping back the jacket 98 exposing an extent of the shield 96. A portion of insulator 94 extends therefrom with an extent of the conductor 92 extending from the insulator 94. The preparation process includes folding back an end extent of the shield 96 about the jacket 98. As shown in exploded view in FIG. 4, the cable 90 may be inserted into the connector 10 with the compression ring 14 coupled to the body 12 as shown in FIGS. 2 and 4. In this technique, the prepared cable 90 is inserted through the outer ring portion 35, through the rearward end 34 of the forward sleeve portion 33, and into the receiving end 24 of the body 12. The extension 30 of the post 20 is inserted between the insulator 94 in the metallic shield 96 such that the shield 96 and the jacket 98 reside within the annular region 32 defined between the post 20 and the rearward portion 16 of the body 12. In this position, the compression ring 14 is coupled to body in the first position shown in FIGS. 2 and 4. In such first position, sufficient clearance is provided between the compression ring 14 and the post 20 so that the extension 30 may easily be interposed between the insulator 94 and the shield 96.

Once the cable 60 is properly inserted, the threaded portion 66 of the compression ring 14 is threadedly coupled with the threaded portion 68 of the body 12, and the compression ring 14 is rotated clockwise relative to the body 12 such that the compression ring 14 moves axially in the direction of arrow A toward the coupler 18. When a radially-inward protruding portion 80 of the forward sleeve portion 33 of the compression ring 14 moves axially over a barbed portion 82 at a rearward end of the extension 30 of the post 20, the forward sleeve portion 33 compresses the folded back metallic shield 96 and jacket 98 of the cable 90 against the extension 30 of the post 20. As a result of this compression, the torque required to continue rotation of the compression ring 14 relative to the body 12 increases. When the desired installation torque is reached, the material of the tabs 38, the tapering of the tabs 38, and/or the strengthening members 39 facilitate breakage of the tabs 38 at the radially inner portion 62 of the tabs 38 that connects to the forward sleeve portion 33 as further torque is applied to the outer ring portion 35 of the compression ring 14. The further torque will cause the tabs 38 to shear such that the outer ring portion 35 becomes separated from the forward sleeve portion 33. The outer ring portion 35 can then be moved rearward along the cable 90 in a direction away from the coupler 18 (opposite to arrow A). At this point, the installer can couple a tightening tool to the connector 10 to tighten the coupler 18 to an interface port.

FIGS. 8-11 illustrate another exemplary coaxial cable connector 110 in accordance with various aspects of the present disclosure. The connector 110 includes a body 12, a torque-limiting compression ring 114, a coupler 18 such as an annular nut, and an outer conductor engager or annular post 20.

The torque-limiting compression ring 114 includes a generally cylindrical forward sleeve portion 133 and a rearward outer ring portion 135. The rearward outer ring portion 135 is attached to the forward sleeve portion 133 by a plurality of tabs or fingers 138 that taper in the radially outward direction (i.e., opposite that illustrated in FIG. 2). The outer ring portion 135 may include one or more torque assisting structures 188. The compression ring 114 is formed of a material selected such that the plurality of tabs 138 will shear when a desired torque is met during installation, as described above in connection with the embodiment shown in FIGS. 1-7. The tapering of the tabs 138 facilitate breakage of the tabs 138 at a radially outer portion 162 of the tabs 138 that connects to the forward sleeve portion 133.

An outer surface 164 of the forward end 136 of the compression ring 114 includes a threaded portion 166 that is threadedly coupled with a threaded portion 68 of the inner surface 13 of the rearward portion 16 of the body 12. The threaded portions 166, 68 allow for detachable, re-attachable connection of the compression ring 114 to the body 12. Furthermore, as the compression ring 114 is rotated clockwise relative to the body 12, the compression ring 114 is axially moveable along arrow A of FIGS. 2 and 8, towards the coupler 18 from a first position shown in FIGS. 2 and 8, which loosely retains the coaxial cable within the body 12 to a more forward second position shown in FIG. 3, which secures the cable within the body 12

Figure 9:
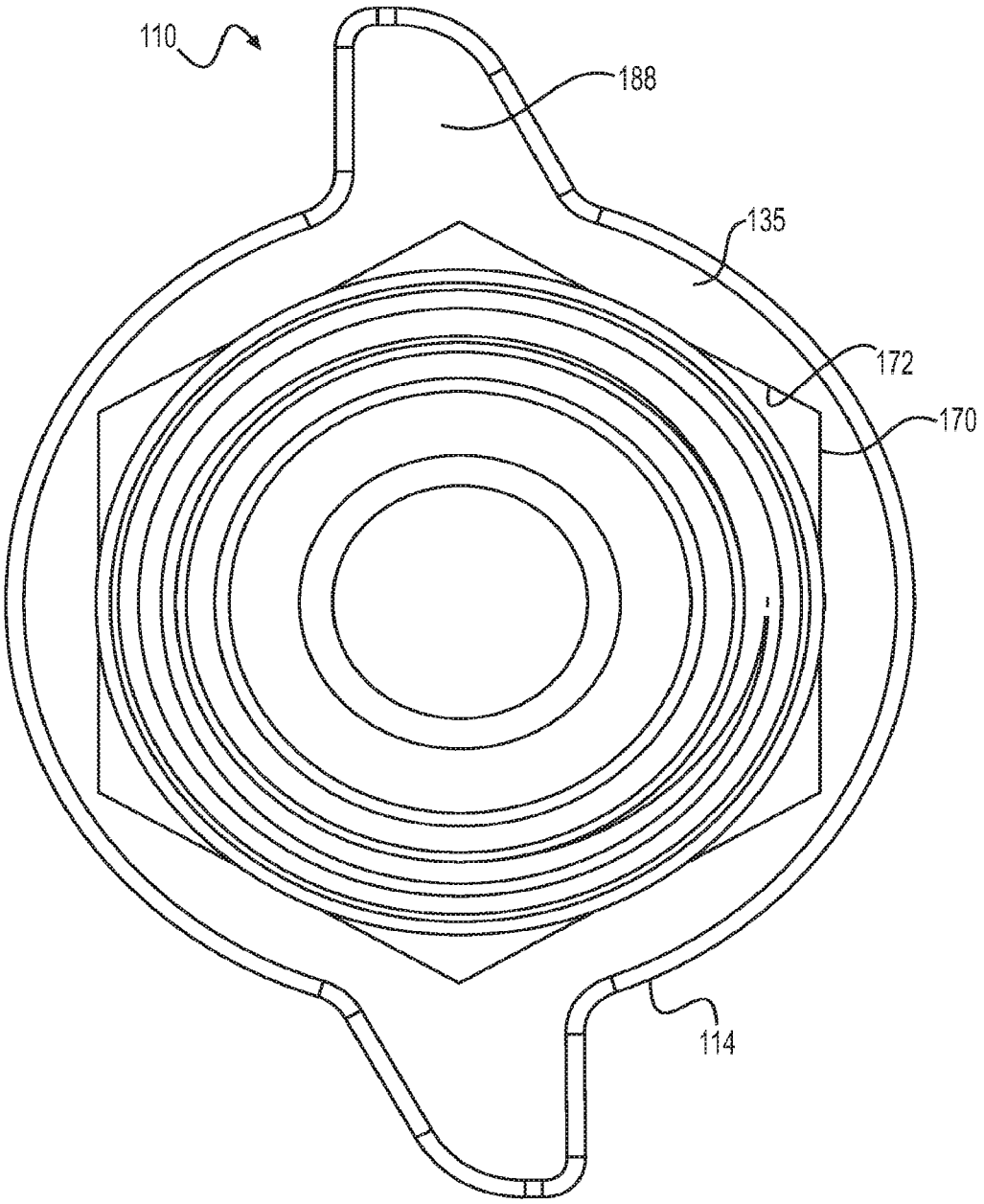
FIG. 9 is a front view of the exemplary coaxial connector of FIG. 8.
Figure 10:
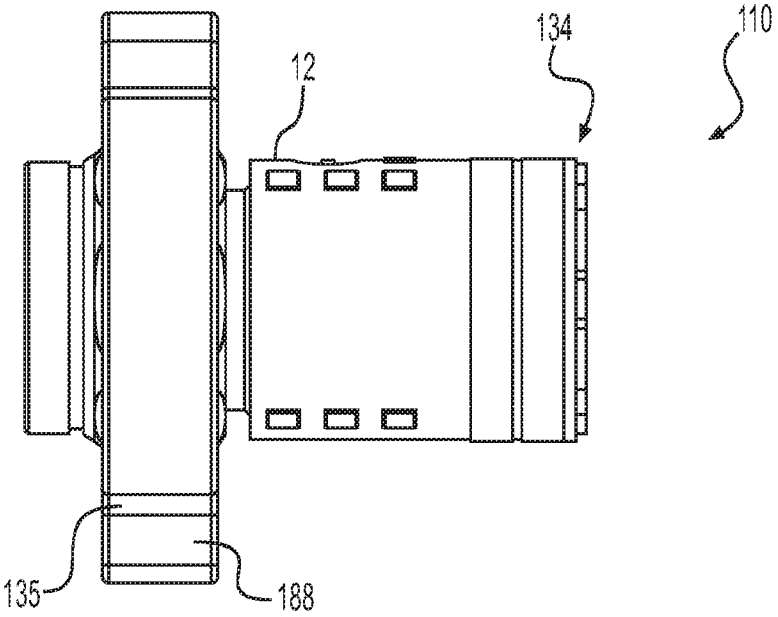
FIG. 10 is a side view of the exemplary coaxial connection of FIG. 8 in a second configuration.
Figure 11:
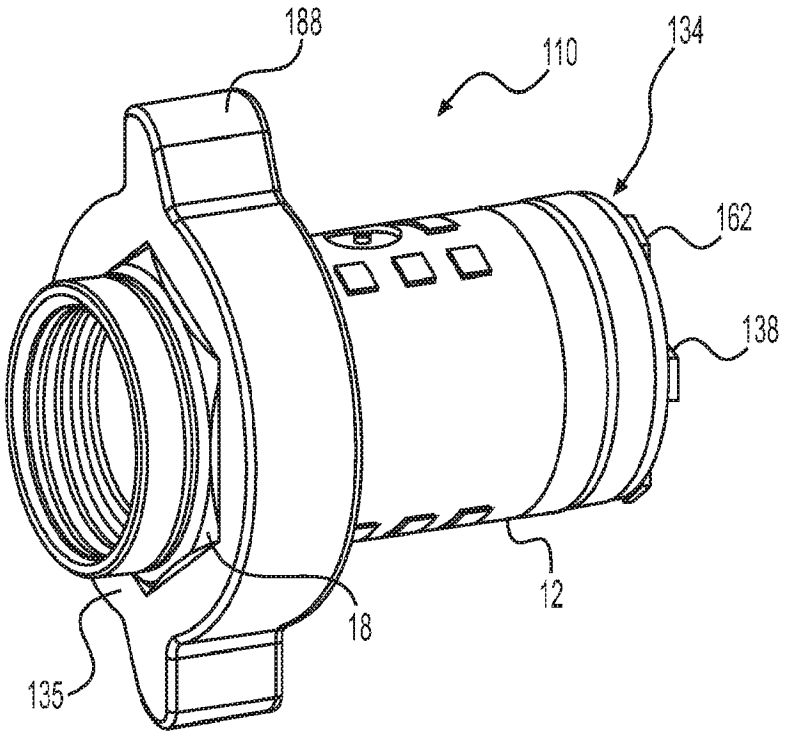
FIG. 11 is a perspective view of the exemplary coaxial connection of FIG. 8 in the second configuration.

Referring to FIGS. 9 and 11, the outer ring portion 135 and tabs of the compression ring 114 may be structured and arranged such that when the tabs shear to separate the outer ring portion 135 from the forward sleeve portion 133, the resultant inner opening 170 is sized to fit over the connector body 12 and onto the coupler 18, and the compression ring 114 can be moved in the direction A to a position about the coupler 18. For example, the inner surface 172 of the sheared-off outer ring portion 135 may have a hexagonal shape that is complementary to the shape of the coupler 18 and the inner opening 170 is sized relative to the coupler 18 such that the outer ring portion 135 can be used as a torque assist member to tighten the coupler 18 to an interface port.

Figure 3:
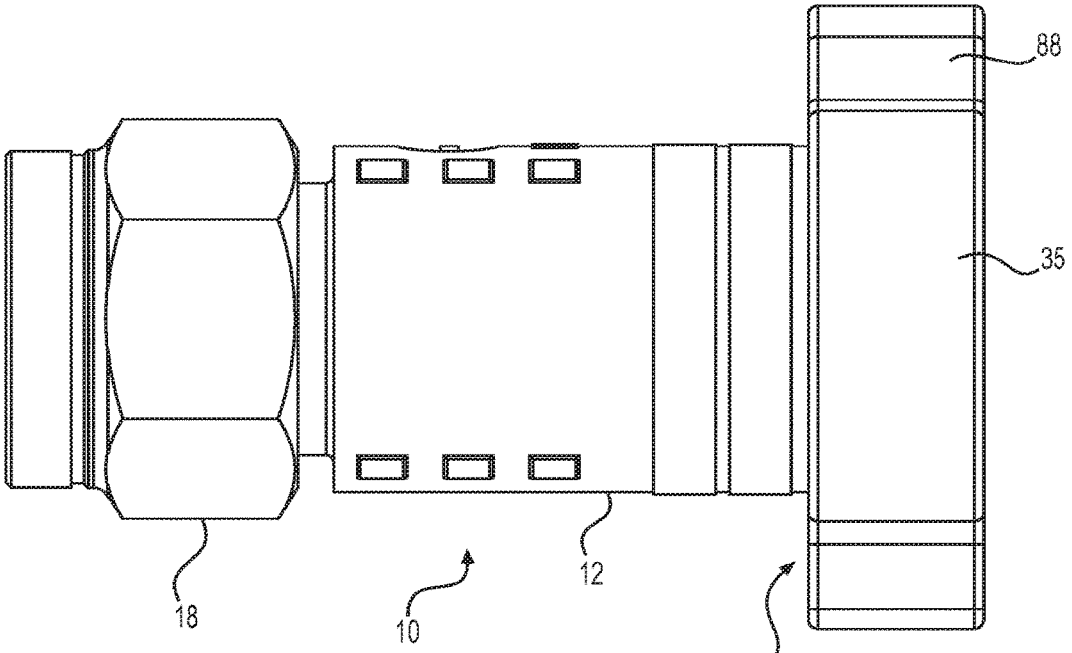
FIG. 3 is a side view of the exemplary coaxial connector of FIG. 1.
Figure 8:
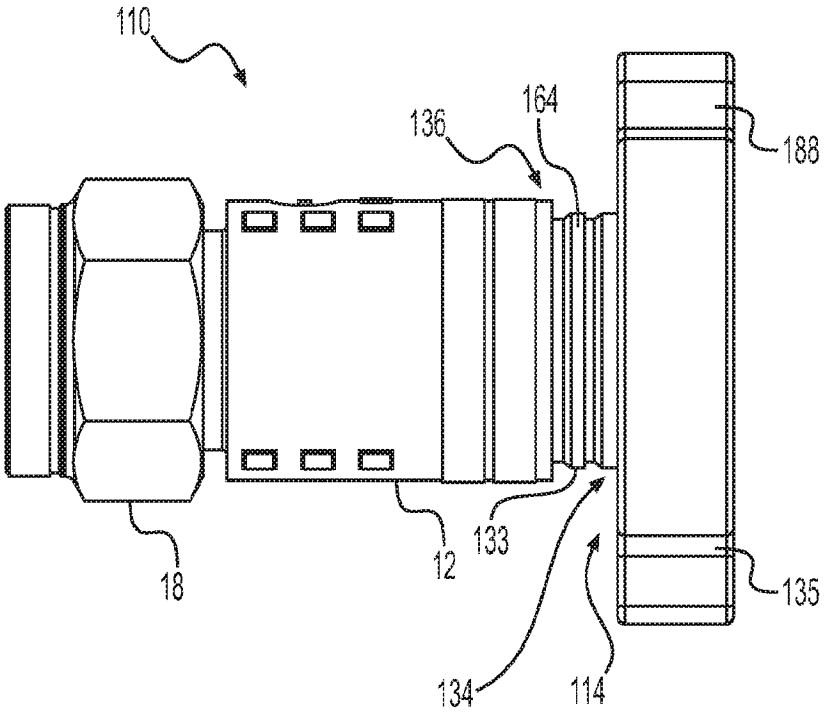
FIG. 8 is a side view of another exemplary coaxial connector in a first configuration in accordance with various aspects of the present disclosure.

As described above, in some aspects, the connectors 10, 110 of the present disclosure may be constructed so as to be supplied in the assembled condition shown in FIGS. 1, 3, and 8. In such an assembled condition, and as will be described in further detail hereinbelow, a coaxial cable may be inserted through the rearward end 34, 134 of the forward sleeve portion 33, 133 of the compression ring 14, 114 and into the body 12. The compression ring 14, 114 may be moved from the first position loosely retaining the cable to the second position which is axially forward thereby locking the cable to the body 12. It is, however, contemplated that, in some aspects, the compression ring 14, 114 may be detached from the body 12 and placed around the coaxial cable, so as to allow the coaxial cable to be inserted directly into the cable receiving end 24 of the body 12. Thereafter, the compression ring 14, 114 which has been placed around the cable may be reattached to the cable receiving end 24 of the body 12 where it can be moved from the first position to the second position locking the cable to the connector body. The threaded portions 66, 166, 68 mentioned above are employed to provide such detachment and reattachment of the compression ring 14, 114 to the body 12. In other embodiments, the connectors 10, 110 may be supplied in an unassembled condition (not shown) where the compression ring 14, 114 is separated from the body 12.

Additional embodiments include any one of the embodiments described above, where one or more of its components, functionalities or structures is interchanged with, replaced by or augmented by one or more of the components, functionalities, or structures of a different embodiment described above.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

What is claimed is:

1. A coaxial cable connector configured to be coupled with an interface port, the connector comprising:

a body having a cable receiving end configured to receive an end of a coaxial cable;

a coupler configured to be coupled with and to rotate relative to the body;

a compression member including a forward portion and a rearward portion attached to one another by a plurality of tabs, the forward portion being configured to be coupled to the cable receiving end of the body;

wherein the plurality of tabs are configured to shear so as to separate the rearward portion from the forward portion when a desired force is met as the compression member is moved relative to the body;

wherein the rearward portion includes an inner opening when separated from the forward portion;

wherein the separated rearward portion is configured to be slidingly moved relative to the body and the coupler; and wherein the inner opening is configured to fit over the coupler such that the rearward portion is permitted to transmit torque to the coupler.

2. The connector of claim 1, wherein the outer portion includes a torque assisting structure.

3. The connector of claim 1, wherein the compression member is formed of a material selected such that each of the plurality of tabs will shear at a radially inner portion of each of the tabs that connects to the forward portion when the desired force is met.

4. The connector of claim 3, wherein the desired force is a torque.

5. The connector of claim 1, wherein each of the tabs includes a strengthening member at its radially outer portion, and the strengthening members are configured to facilitate breakage of the tabs at a radially inner portion of each of the tabs that connects to the forward portion.

6. The connector of claim 1, wherein the body includes at least one stop configured to prevent the compression member from being overtightened to the body.

7. The connector of claim 1, wherein an outer surface of the forward portion of the compression member includes a threaded portion that is configured to be threadedly coupled with a threaded portion of an inner surface of the body.

8. The connector of claim 1, wherein the compression member is configured to move axially toward the coupler at a forward end of the connector as the compression member is rotated clockwise relative to the body.

9. The connector of claim 8, wherein the compression member is configured to move axially from a first position, which loosely retains a coaxial cable within the body, to a more forward second position, which secures the cable within the body, as the compression member is rotated clockwise relative to the body.

10. The connector of claim 1, wherein the inner opening has a shape that matches a shape of an outer surface of the coupler.

11. A coaxial cable connector configured to be coupled with an interface port, the connector comprising:

a body having a cable receiving end configured to receive an end of a coaxial cable;

a coupler configured to be coupled with and to rotate relative to the body;

a compression member including a forward portion and a rearward portion attached to one another by a plurality of tabs, the forward portion being configured to be coupled to the cable receiving end of the body;

wherein the plurality of tabs are configured to shear so as to separate the rearward portion from the forward portion when a desired force is met as the compression member is moved relative to the body;

wherein the rearward portion includes an inner opening when separated from the forward portion; and wherein the separated rearward portion is configured to be slidingly moved relative to the body and the coupler.

12. The connector of claim 11, wherein the outer portion includes a torque assisting structure.

13. The connector of claim 11, wherein the compression member is formed of a material selected such that each of the plurality of tabs will shear at a radially inner portion of each of the tabs that connects to the forward portion when the desired force is met.

14. The connector of claim 11, wherein each of the tabs includes a strengthening member at its radially outer portion, the strengthening members being configured to facilitate breakage of the tabs at a radially inner portion of each of the tabs that connects to the forward portion.

15. The connector of claim 11, wherein the body includes at least one stop configured to prevent the compression member from being overtightened to the body.

16. The connector of claim 11, wherein an outer surface of the forward portion of the compression member includes a threaded portion that is configured to be threadedly coupled with a threaded portion of an inner surface of the body.

17. The connector of claim 11, wherein the compression member is configured to move axially toward the coupler at a forward end of the connector as the compression member is rotated clockwise relative to the body.

18. The connector of claim 17, wherein the compression member is configured to move axially from a first position, which loosely retains a coaxial cable within the body, to a more forward second position, which secures the cable within the body, as the compression member is rotated clockwise relative to the body.

19. The connector of claim 11, wherein the inner opening has a shape that matches a shape of an outer surface of the coupler.

20. A coaxial cable connector configured to be coupled with an interface port, the connector comprising:

a body portion having a cable receiving end configured to receive an end of a coaxial cable;

a coupler portion configured to be coupled with and to rotate relative to the body portion;

a compression portion including a forward portion and a rearward portion attached to one another by a connection portion; and wherein the connection portion is configured to shear at a desired force to separate the rearward portion from the forward portion such that the rearward portion is configured to be slidingly moved over the coupler so as to permit the rearward portion to transmit torque to the coupler.

21. The connector of claim 20, wherein the connection portion is configured such that the desired force is met as the compression portion is moved relative to the body portion.

22. The connector of claim 20, wherein the outer portion includes a torque assisting structure.

23. The connector of claim 20, wherein the compression portion is formed of a material selected such that the connection portion will shear at a radially inner portion of the connection portion that connects to the forward portion when the desired force is met.

24. The connector of claim 23, wherein the desired force is a torque.

25. The connector of claim 20, wherein the connection portion includes a strengthened portion at its radially outer portion, and the strengthened portion is configured to facilitate breakage of the connection portion at a radially inner portion of the connection portion that connects to the forward portion.

26. The connector of claim 20, wherein the body portion includes at least one stop portion configured to prevent the compression portion from being overtightened to the body portion.

27. The connector of claim 20, wherein the compression portion is configured to be threadedly coupled with the body portion.

28. The connector of claim 20, wherein the connection portion comprises a plurality of tabs that are spaced apart from one another in a circumferential direction.

29. The connector of claim 20, wherein the compression portion is configured to move axially toward the coupler portion at a forward end of the connector to couple the connector to an end of a coaxial cable.

30. The connector of claim 29, wherein the compression portion is configured to move axially from a first position, which loosely retains a coaxial cable within the body portion, to a more forward second position, which secures the cable within the body, as the compression portion is rotated relative to the body portion.

31. The connector of claim 20, wherein the rearward portion of the compression portion includes an inner opening having a shape that matches a shape of an outer surface of the coupler portion.

32. A coaxial cable connector configured to be coupled with an interface port, the connector comprising:

a body portion having a cable receiving end configured to receive an end of a coaxial cable;

a coupler portion configured to be coupled with and to rotate relative to the body portion;

a compression portion including a forward portion and a rearward portion attached to one another by a connection portion; and wherein the connection portion is configured to shear at a desired force to separate the rearward portion from the forward portion so as to permit the rearward portion to be slidingly moved relative to the body and the coupler.

33. The connector of claim 32, wherein the connection portion is configured such that the desired force is met as the compression portion is moved relative to the body portion.

34. The connector of claim 32, wherein the outer portion includes a torque assisting structure.

35. The connector of claim 32, wherein the compression portion is formed of a material selected such that the connection portion will shear at a radially inner portion of the connection portion that connects to the forward portion when the desired force is met.

36. The connector of claim 35, wherein the desired force is a torque.

37. The connector of claim 32, wherein the connection portion includes a strengthened portion at its radially outer portion, and the strengthened portion is configured to facilitate breakage of the connection portion at a radially inner portion of the connection portion that connects to the forward portion.

38. The connector of claim 32, wherein the body portion includes at least one stop portion configured to prevent the compression portion from being overtightened to the body portion.

39. The connector of claim 32, wherein the compression portion is configured to be threadedly coupled with the body portion.

40. The connector of claim 32, wherein the connection portion comprises a plurality of tabs that are spaced apart from one another in a circumferential direction.

41. The connector of claim 32, wherein the compression portion is configured to move axially toward the coupler portion at a forward end of the connector to couple the connector to an end of a coaxial cable.

42. The connector of claim 41, wherein the compression portion is configured to move axially from a first position, which loosely retains a coaxial cable within the body portion, to a more forward second position, which secures the cable within the body, as the compression portion is rotated relative to the body portion.

43. The connector of claim 32, wherein the rearward portion of the compression portion includes an inner opening having a shape that matches a shape of an outer surface of the coupler portion.

* * * * *